United States Patent [19]

Betterton et al.

[11] Patent Number: 4,706,707

[45] Date of Patent: Nov. 17, 1987

[54] FUEL INLET ASSEMBLY

[75] Inventors: Joseph T. Betterton, Arab; Alan W. Dykoski, Huntsville; Alfred H. Glover, Decatur; Daniel F. Lawless, Hazel Green; William D. McKee, Huntsville; Troy T. Watson, Decatur, all of Ala.

[73] Assignee: Chrysler Motors Corporation, Highland Park, Mich.

[21] Appl. No.: 906,049

[22] Filed: Sep. 11, 1986

[51] Int. Cl.[4] ..... E03B 11/16; F04B 11/00

[52] U.S. Cl. ..... 137/565; 137/434; 137/558; 137/592

[58] Field of Search ..... 137/590, 565, 434, 448, 137/558; 417/363

[56] References Cited

U.S. PATENT DOCUMENTS

| | | | |
|---|---|---|---|
| 3,049,171 | 8/1962 | Neuerburg | 137/592 |
| 3,221,800 | 12/1965 | Ballou | 137/558 |
| 3,354,905 | 11/1967 | Lewis et al. | 137/590 |
| 4,340,023 | 7/1982 | Creager | 137/590 |
| 4,569,637 | 2/1986 | Turkey | 417/363 |
| 4,590,964 | 5/1986 | Beardmore | 137/590 |

*Primary Examiner*—A. Michael Chambers

*Attorney, Agent, or Firm*—Kenneth H. MacLean, Jr.

[57] ABSTRACT

A combination fuel delivery, pick-up and fuel level sensor of the type including conduits at least one of which is formed in a helix configuration so as to locate and bias the inlet closely adjacent the fuel tank bottom irrespective of differences in the depth dimension of associated fuel tanks.

1 Claim, 5 Drawing Figures

FUEL INLET ASSEMBLY

BACKGROUND OF THE INVENTION

There are many designs of fuel delivery assemblies for vehicle fuel tanks. Typically, the wall of the tank has an access opening provided for insertion of the fuel inlet assembly in the tank. The delivery assembly includes a fuel reservoir, a fuel filter, a liquid level sensor apparatus and, often, an in-tank electric fuel pump and fuel conduits. The electric fuel pump, whether in-tank or not, generally has a capacity to pump a greater flow of fuel than the engine utilizes so that a fuel return conduit is commonly provided to return a flow of excess fuel back to the fuel tank. Finally, a base or cover plate supports the aforementioned components and also covers the fuel tank access opening.

The above-described fuel delivery components work well when the fuel inlet is located in closely spaced relation to the fuel tank bottom wall. Modern vehicle lines often share basic components, such as the fuel inlet assemblies described heretofore. Because the fuel tanks of different vehicles often vary in dimension, such as depth, it is desirable to provide a common fuel inlet assembly which is adaptable for use with different tanks.

A number of patents have disclosed the general configuration described above. Namely, a typical fuel inlet assembly is disclosed in U.S. Pat. No. 4,557,144. In this patent, a fuel inlet assembly includes a fuel level indicator mechanism, a fuel inlet means and a cover or support plate. The fuel inlet is in the form of a rigid conduit and, thus, the aforesaid desirability of a flexible or resilient assembly for a accommodating tanks of varying depth is not disclosed. Another patent, U.S. Pat. No. 4,546,750, disclosed an in-tank fuel pump and reservoir assembly which includes a fuel return conduit. The fuel inlet assembly is in the form of a straight conduit which would not exhibit the required flexibility described above. The U.S. Pat. No. 4,306,844 discloses an assembly including a reservoir supported on the bottom of a fuel tank which itself supports a fuel pump and filter assembly. Lacking is a device to resiliently and flexibly bias the assembly against the tank bottom. A fuel inlet, pump and filter assembly is shown in U.S. Pat. No. 3,910,464 which discloses a resilient means of mounting the components from an access opening cover member. The resilient means do not provide the flexible downward bias described above, but instead are for the purpose of allowing upward movement of the pump from the pump seat when an application of a large upward or horizontal force is applied to the pump. The U.S. Pat. No. 3,354,905 discloses a gas distributor for a bottle utilizing a spring to hold the outlet to the bottom of the bottle.

SUMMARY OF THE INVENTION

The subject fuel delivery assembly has an object of providing a support for a fuel delivery inlet and its filter including a fuel pump in the tank if desired. The assembly also includes a fuel return for returning excess fuel to the tank which excess is produced by an electric type fuel pump. The pump's capacity is generally large and fuel unused by the engine in its operation of the vehicle is returned. In addition, a drain conduit may be provided to selectively remove the fuel from the tank, such as when the tank is to be removed from the vehicle. Another reason for the drain is for supplying fuel to a motor home generator engine. It could also be used to remove any water in the tank. The drain conduit, or if none, a fuel return may be formed in a helical fashion between a support member which also supports the fuel pump or fuel inlet. The return conduit is formed of metal tubular material and establishes a yieldable connection between the support and the fuel inlet. This biases the fuel inlet against the bottom of the fuel tank thereby providing a less vibratory and more efficient fuel pick-up assembly.

The fuel delivery assembly is adapted for insertion through an access opening in a fuel tank and includes a cover member adapted to seal this access opening when the assembly is installed in the tank. The cover member is also the support for the helically formed conduit of metallic tubing which acts as an axially extendable or yieldable device for biasing the fuel inlet and a filter associated therewith against the bottom wall of a fuel tank.

Further advantages and objects of the subject invention will be more readily perceived by a reading of the detailed description of a preferred embodiment, reference being had to the accompanying drawings in which a preferred embodiment is illustrated.

IN THE DRAWINGS

DETAILED DESCRIPTION OF THE EMBODIMENT

Figure 1:
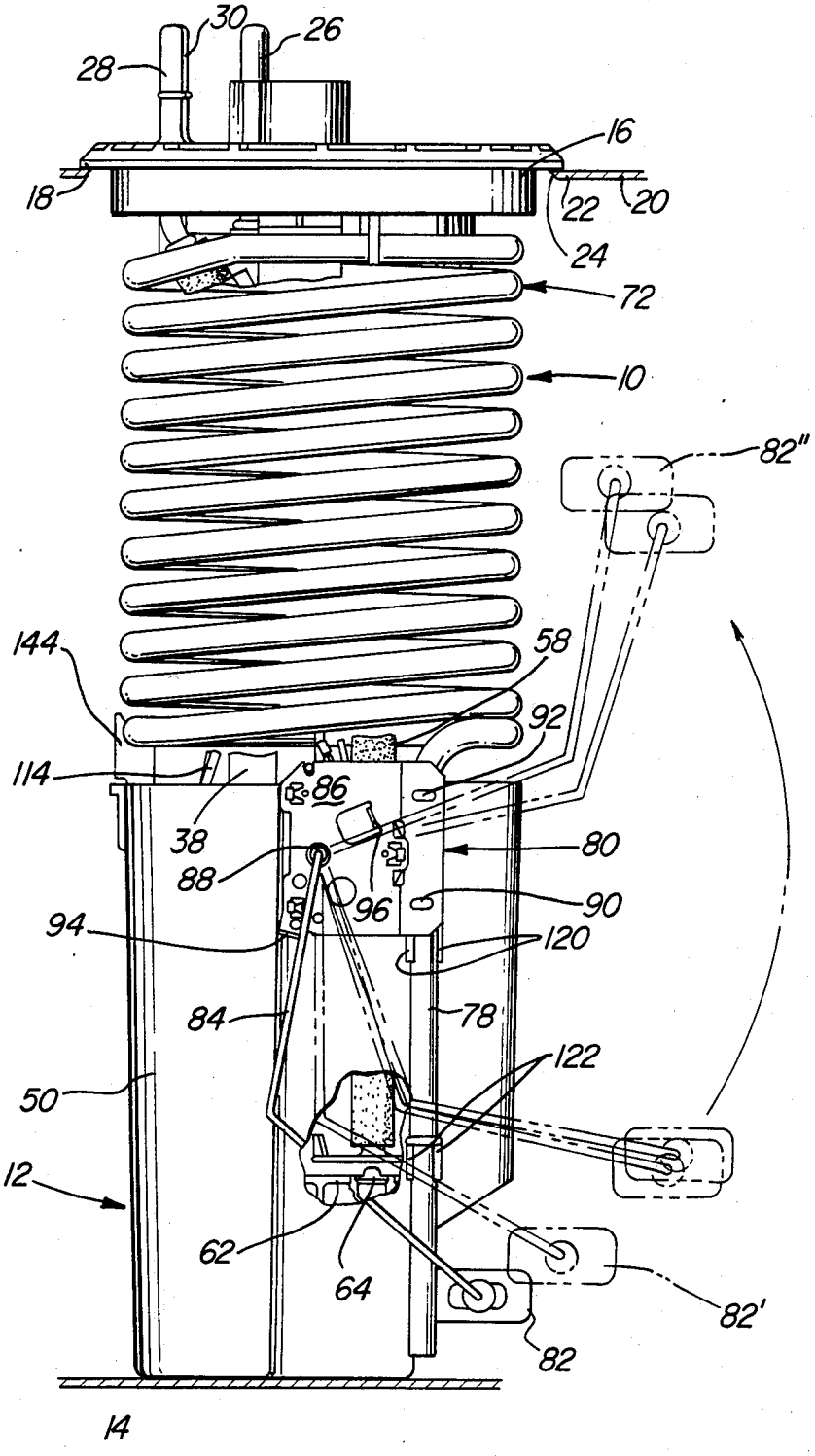
FIG. 1 is an elevational view of the fuel delivery assembly and its relationship to the top and bottom wall of a fuel tank.

In FIG. 1, the subject fuel delivery assembly 10 is illustrated. Assembly 10 includes a lower portion 12 positioned just above the bottom wall 14 of a vehicle fuel tank. The assembly 10 includes a cover or support member 16 with a peripheral edge portion 18 adapted to be attached to the top wall 20 of the fuel tank. Specifically, the support member 16 is attached to an edge portion 22 of the top wall 20 which encircles and forms an access opening 24 therethrough. The access opening 24 is adapted to permit the assembly 10 to be inserted into the interior of the fuel tank between bottom wall 14 and top wall 20.

Figure 4:
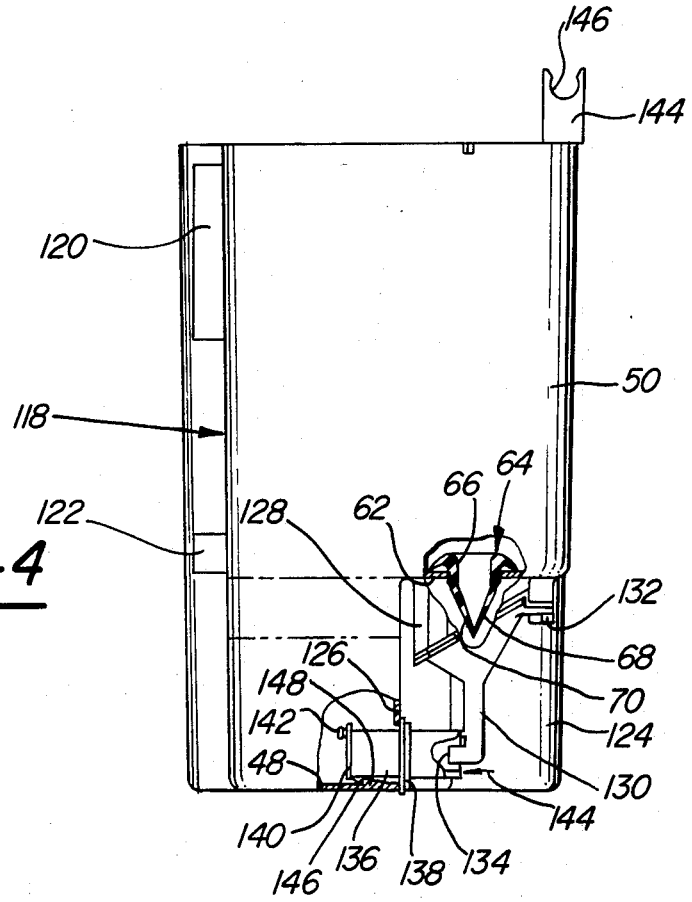
FIG. 4 is an elevational partially sectioned view of the lower reservoir portion of the assembly shown in FIG. 1.
Figure 3:
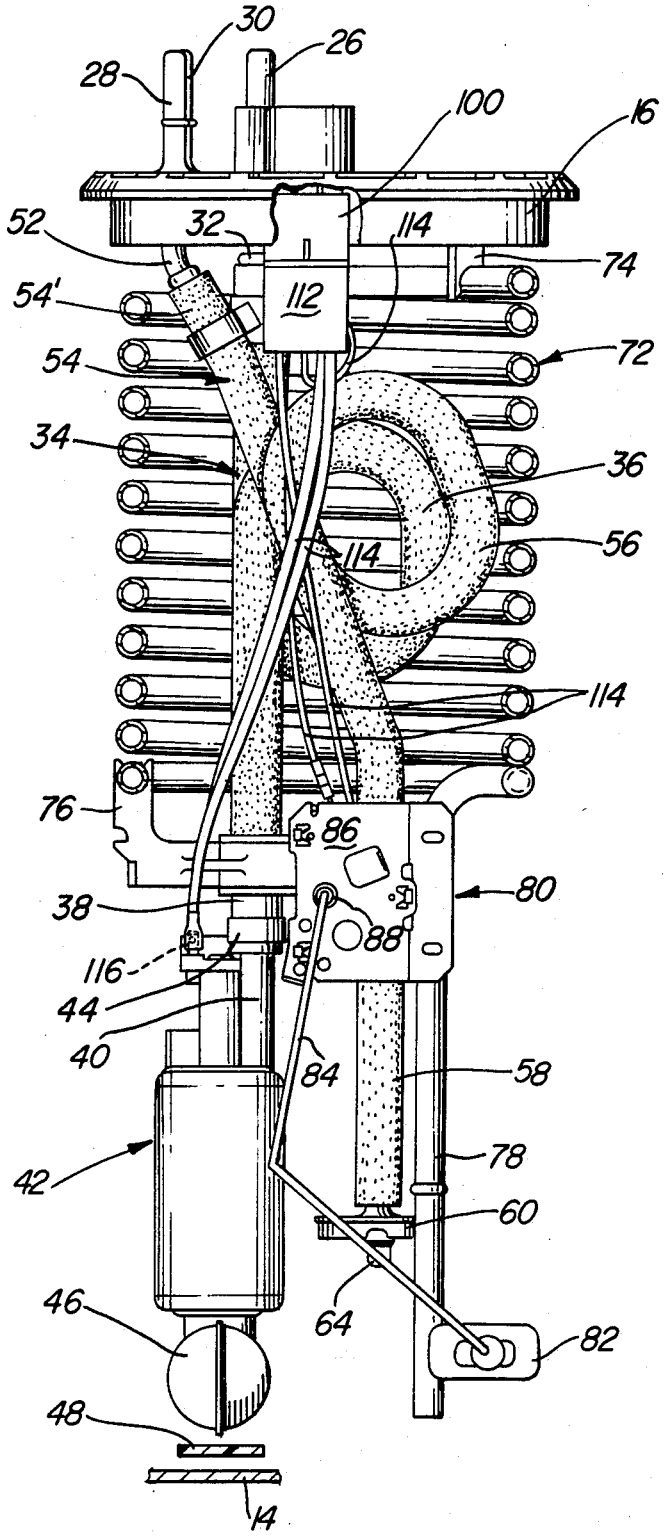
FIG. 3 is an elevational partially sectioned view of the assembly shown in FIG. 1.

The support member 16 includes three tubular end portions or fittings 26, 28 and 30, which extend through the support or cover 16. The members 26, 30 are tubular metal members for conducting fuel flow through the cover 16. Specifically, the member 26 is the fuel outlet fitting or supply to the vehicle engine and includes a portion 32 extending below the support 16 as shown in FIG. 3. Portion 32 is telescopically attached to a larger diameter elastomeric hose member 34 which extends downward therefrom. The member 34 is formed into a 360 degree loop portion 36 at its midportion. A lower end portion 38 of the hose 34 is attached to an outlet boss portion 40 of a liquid fuel pump assembly 42 by a radially inwardly restrictive clamping ring 44. The fuel pump 42 receives fuel from a lower inlet portion (not visible) within the interior of a filter or strainer assembly 46. The filter 46 and inlet are positioned adjacent the bottom wall 48 of a hollow container or reservoir assembly 50 as shown in FIGS. 1 and 4. The assembly 50 is basically a cupshaped container adapted to receive fuel about the inlet and filter 46. Resultantly, a liquid level within the container 50 may be built up above a relatively low level surrounding the container when the fuel tank is near empty. Thus, the reservoir 50 provides an adequate supply of fuel so that the fuel pump 42 can function even when the fuel level in the tank is close to the bottom wall 14 of the fuel tank.

The container 50 is filled with fuel through a tubular fitting 28 on the support 16. Specifically, the fitting 28 extends through the support 16 to a lower portion 52 thereof. The portion 52 is telescopically received in the upper end of an elastomeric hose 54 which extends downward. A looped portion 56 of the hose 54 is formed. The lower end portion 58 of the hose 54 is connected to an outlet fitting 60 adapted to seatingly engage an apertured inner wall 62 of the reservoir assembly 50. Specifically, as shown in FIG. 4, the wall 62 has an aperture therethrough which receives the upper end portion of an elastomeric check valve assembly 64. The assembly 64 has a central flow channel 66 and a normally closed lower end portion formed by abutting wall portions 68 and 70 which are resiliently biased toward one another. The valve assembly 64 is a "duckbill" type check valve with the lower portions 68 and 70 normally closed by the molded properties of the material. The portion 68 and 70 are free under fluid pressure to move apart to permit a downward flow when a slight positive pressure differential exists within the assembly 64 relative to beneath the assembly.

Located behind the fitting 28 in FIG. 1 and supported by the support 16 is the third fitting 30 which also extends through the support 16 and is connected to a helically configured metallic tube structure 72. The helically configured hollow metallic tubing is best shown in FIG. 3 and is supported at an upper end by a depending tab or leg 74 and supported at a lower end by an upwardly extending leg or tab 76. The leg 76 extends downward and then inward toward hose 34. The helically configured assembly 72 includes a straight vertically downward extending portion 78 with an open end terminating slightly above the bottom wall 14 of the fuel tank. The portion 78 supports a level sensor assembly 80 which includes a liquid following float member 82 attached by an arm 84 to a body portion including a base plate 86. The upper end of arm 84 extends through an opening 88 in the plate 86 and is attached to a contact carrying arm portion (behind plate 86) which is moved through a semi-circular arc as the float 82 moves from lower position 82′ to a higher level 82″ as shown in FIG. 1. These positions correspond to a low fuel level and a high fuel level, respectively. The plate 86 is fastened to the portion 78 at points 90 and 92 by spot welds. The arm 84 is stopped from further clockwise rotation at its lower level by a tab 94 on the member 86. Arm 84 is stopped from further counterclockwise rotation at its upper level by a similar tab 96 extending from member 86.

Figure 2:
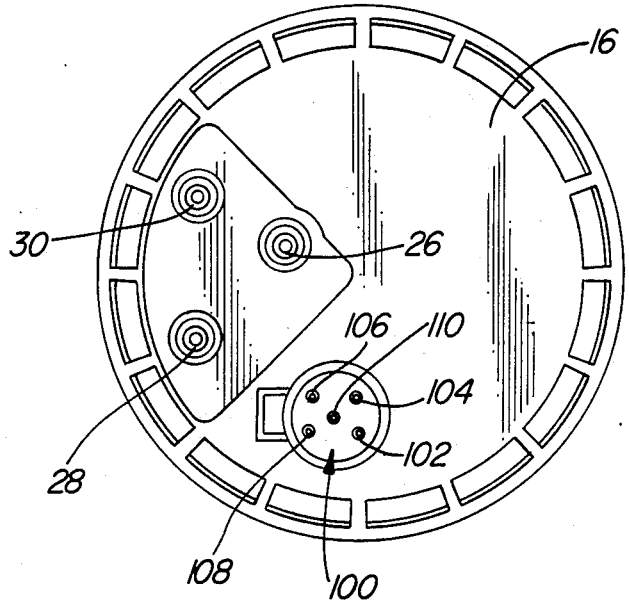
FIG. 2 is a top view of the fuel inlet assembly shown in FIG. 1.
Figure 5:
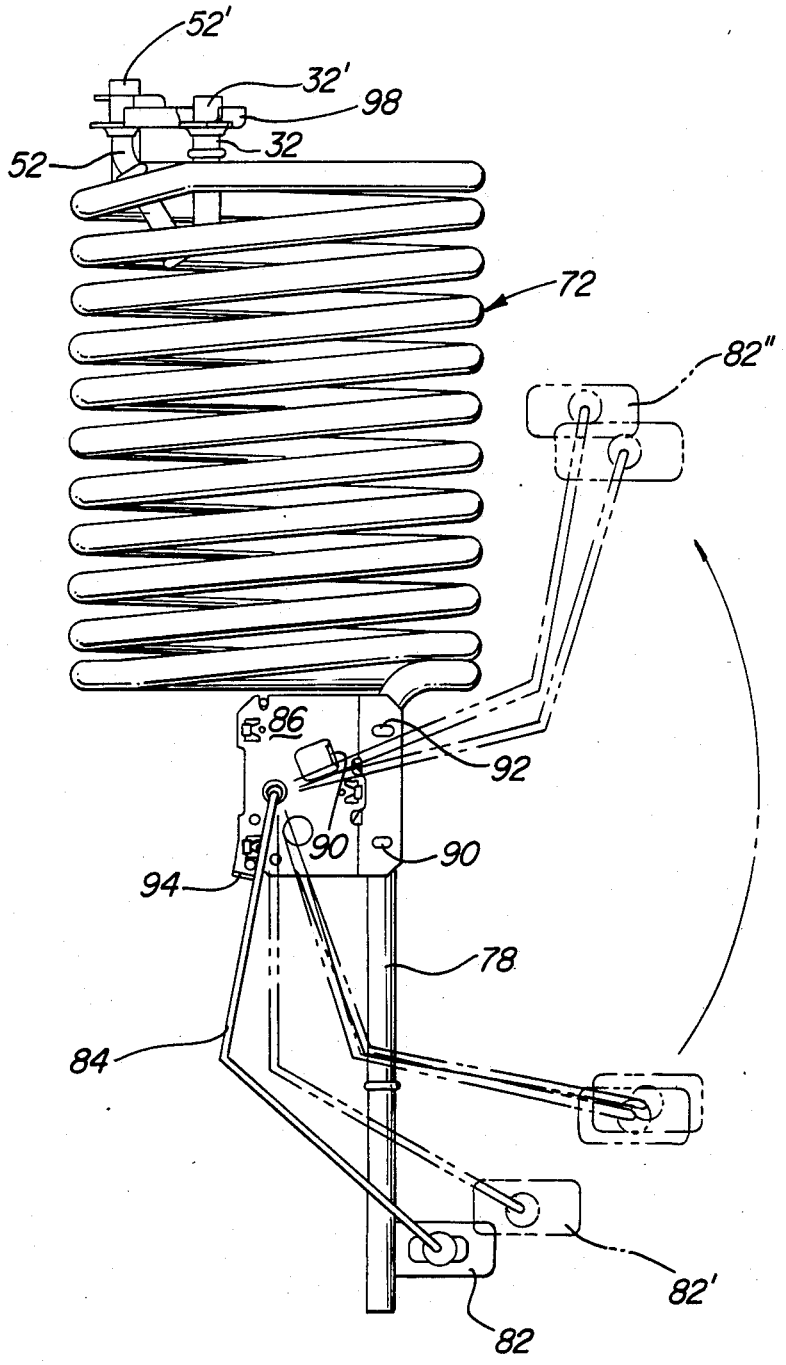
FIG. 5 is an elevational view of a portion of the fuel intake assembly shown in FIG. 1.

Referring to FIG. 2, a planar view of the support or cover 16 is illustrated showing the fittings 26, 28 and 30 extending therefrom. Specifically, as shown, the fittings 26, 28 and 30 may be formed integral with the support 16 and provide cylindrical recesses beneath the plate 16 for receiving the portions 32, 52 and the upper end of assembly 72, respectively. In FIG. 5, the upper ends 32'and 52'are shown. The portions are supported and spaced relative to one another by a backup mounting plate 98 which is attached to the underside of the support 16. Also visible in FIG. 2 is an electrical multichannel plug fitting 100 for connecting various components such as the fluid level sensor to electrical system of an associated vehicle. Specifically, member 100 has five pin receivers 102, 104, 106, 108 and 110 for electrical hookup. In this regard, beneath the support plate 16 is a corresponding mating plug member 112 from which five wires 114 are connected and which extend to the various electrical components of the assembly. Specifically, one wire is connected to the pin receiver 102 downward to the positive terminal 116 of the fuel pump 42. Likewise, the pin receiver 104 is connected by a wire to the negative terminal of the fuel pump 42 (behind terminal 116). Similarly, a wire connected to the pin receiver 106 extends to one end of an arcuate shaped wire wound resistor behind the fuel level sensing base 86. The wire wound resistor is contacted by the pad carrying arm of the sensing device 80 as it is moved through an arc by corresponding movement of the float 82 as transmitted by arm 84. The other end of the wire wound resistor is connected to ground which, in turn, is connected through the helically formed assembly 72 to the support 16. The pin receiver 110 is connected by a wire 114 to the support 16. In addition, the pin receiver 108 is connected to a part of the fluid level assembly 80 which makes contact with the grounded housing thereof only when the float 82 reaches a predetermined low level, thus activating a warning light of the associated vehicle.

The receiver assembly 50 shown in FIG. 1 was previously described. In FIG. 4, an elevational view of the receiver is shown taken 90 degrees from the view in FIG. 1. The receiver 50 is basically a thin walled cupshaped member with an open top adapted to surround the components shown in FIG. 3, namely the fuel pump 42 with its filter 46. As can be seen in FIG. 4, the reservoir 50 is provided with a channel configured edge portion 118 along which the straight portion 78 of the structure 72 extends. The portion 78 is secured to the reservoir by means of molded tabs 120 and 122, also shown in FIG. 1.

The reservoir 50 is also provided with a recess best shown in FIG. 4 which is partially defined by wall 62 previously mentioned and vertical side walls 124, 126. The wall 62 supports a hollow enclosure or housing 128 to which a depending jet tube assembly 130 is attached by fasteners 132 (one of which is shown). The assembly 130 is hollow and open at its lower end 134 which turns normally to the depending portion. Fuel from the engine thus returns to fitting 28 and flows through portion 52 and hose 54 into the check valve assembly 64. This excess fuel flows past the check valve 64 and downward through the jet assembly 130 and from the end 134. The end 134 is positioned centrally in a hollow tubular member or aspirator 136. The aspirator extends through the reservoir wall 126 into the interior of the reservoir. The tube 136 is sealed with respect to housing 126 by a seal member and gasket 138. The outlet end of the tube 136 is normally covered by a flat elastomeric check valve member 140 which is supported by fastener 142. When fuel flows through the tube 136 (toward the left in FIG. 4), the valve member 140 is moved to the left, thus permitting flow into the interior of the reservoir 50.

However, the valve 140 will not permit the flow of fuel from the interior of the reservoir 50 past valve 140.

The purpose of the aspirator tube 130 and, specifically, the flow of return fluid from the end 134 of the jet, is to draw additional fuel from the tank into the reservoir assembly 50 from the lower portions of the fuel tank and through the annular space therebetween as indicated by the arrow 144. When the fuel level in the tank is at a low level of, say, an inch, there may be periods caused by movement of the vehicle where the fuel pump would not be able to pick up fuel from the fuel tank without a device such as the reservoir 50. The reservoir 50 provides a relatively high level of fuel over the filtered inlet portion 46 of the fuel pump 42 even when the fuel level in the tank is low.

The reservoir 50 is attached about the fuel pump 42 and the lower end of the assembly 10 by means of the aforementioned tabs 120 and 122 which snap around the vertically depending portion 78 of the helically formed member 72. Located diametrically opposite the tabs 120 and 122, is a further tab means 144 which includes a semi-circular receiving portion 146 for snapping around a portion of the helically formed assembly 72 as best shown in FIG. 1.

A feature, not previously explained, is the downwardly extending tab 146 formed on the tube 136 and shown in FIG. 4. The tab 146 is adapted to operationally engage an upwardly extending tab or part of member 148. The interaction therebetween is for the purpose of securing the tubular member 136 to the reservoir assembly 50. It is believed that some modifications of the fuel delivery can be made without falling outside of the scope of the following claims which define the invention.

We claim:

1. In a vehicle fuel tank with top and bottom walls, a fuel delivery assembly, comprising: a fuel reservoir enclosure means for storing a small quantity of fuel; a fuel pump in the reservoir enclosure, the fuel pump having inlet and outlet means; a combined fuel return conduit and support for positioning the assembly in the fuel tank in registered relation to a bottom wall thereof; a support cover member connected to the fuel tank; the fuel return conduit and support being in the form of a hollow metallic tube with a substantially helical configuration, an upper end of the tube being attached to the support member and the lower end portion of the tube terminating near the tank bottom and being operably attached to the reservoir means and fuel pump; the helical tube having axially spaced coils between its end portions for allowing a variance in the axial length of the combination fuel return and support, the axial length of the helical configuration being selected in relation to the dimensions of the fuel tank to produce a decreased axial length of the helical configuration when the assembly is installed in the fuel tank and the support cover is attached to the fuel tank so that the reservoir is forced against the fuel tank bottom wall by the yieldable shortening in axial length of the helical configuration.

* * * * *